US008944639B2

(12) United States Patent
Anderson

(10) Patent No.: US 8,944,639 B2
(45) Date of Patent: Feb. 3, 2015

(54) LED ROOM LIGHT WITH MULTIPLE LEDS AND RADIATOR FINS

(71) Applicant: Leroy E. Anderson, Boise, ID (US)

(72) Inventor: Leroy E. Anderson, Boise, ID (US)

( * ) Notice: Subject to any disclaimer, the term of this patent is extended or adjusted under 35 U.S.C. 154(b) by 220 days.

(21) Appl. No.: 13/715,678

(22) Filed: Dec. 14, 2012

(65) Prior Publication Data

US 2013/0154465 A1 Jun. 20, 2013

Related U.S. Application Data

(60) Provisional application No. 61/570,674, filed on Dec. 14, 2011.

(51) Int. Cl.

| | |
|---|---|
| ***F21V 29/00*** | (2006.01) |
| ***F21K 99/00*** | (2010.01) |
| ***F21V 3/00*** | (2006.01) |
| ***F21V 3/02*** | (2006.01) |
| *F21V 3/04* | (2006.01) |
| *F21Y 101/02* | (2006.01) |

(52) U.S. Cl.

CPC ..... *F21V 29/004* (2013.01); *F21V 29/2225* (2013.01); *F21V 29/2293* (2013.01); *F21K 9/1355* (2013.01); *F21V 3/005* (2013.01); *F21V 3/02* (2013.01); *F21V 29/2243* (2013.01); *F21V 3/0418* (2013.01); *F21V 3/0436* (2013.01); *F21Y 2101/02* (2013.01)

USPC ..... 362/294; 362/249.02

(58) Field of Classification Search

None

See application file for complete search history.

(56) References Cited

U.S. PATENT DOCUMENTS

| | | | | |
|---|---|---|---|---|
| 7,753,560 | B2 * | 7/2010 | Xu et al. | 362/294 |
| 8,541,933 | B2 * | 9/2013 | Chowdhury et al. | 313/46 |
| 2009/0116233 | A1 * | 5/2009 | Zheng et al. | 362/234 |
| 2009/0195186 | A1 * | 8/2009 | Guest et al. | 315/294 |
| 2010/0033969 | A1 * | 2/2010 | Hochstein et al. | 362/249.03 |
| 2010/0053963 | A1 * | 3/2010 | Yang et al. | 362/249.02 |
| 2010/0156325 | A1 * | 6/2010 | Nelson | 315/307 |
| 2010/0254133 | A1 * | 10/2010 | Cheng | 362/235 |
| 2011/0018437 | A1 * | 1/2011 | Rossi | 315/35 |
| 2011/0080096 | A1 * | 4/2011 | Dudik et al. | 315/112 |
| 2011/0080742 | A1 * | 4/2011 | Allen et al. | 362/294 |
| 2011/0089838 | A1 * | 4/2011 | Pickard et al. | 315/113 |
| 2012/0043878 | A1 * | 2/2012 | Liang et al. | 313/317 |

* cited by examiner

*Primary Examiner* — Britt D Hanley

(74) *Attorney, Agent, or Firm* — Robert L. Shaver; Dykas & Shaver

(57) ABSTRACT

Disclosed is a light bulb which utilizes LEDs which replaces an incandescent light bulb in a fixture for incandescent light bulbs. The LED light bulb includes a multiple fins on a globe base, with an LED light on an outward facing side of each fin. The fins are in contact with heat dissipation structures, and they are adjacent to air vents which aid in heat dissipation. The heat dissipation structures include a heat transfer column which extends from the LEDs to the base of the bulb. A removable cover is enclosed which has openings for air circulation within the globe of the light bulb.

10 Claims, 1 Drawing Sheet

LED ROOM LIGHT WITH MULTIPLE LEDS AND RADIATOR FINS

BACKGROUND

Light emitting diodes (LEDs) have been used in recent years in more and more lighting applications. Some have been used to light room lights, and even to operate in fixtures for conventional light bulbs. A problem with all LED lights is dissipating the heat from the LED itself. The heat from the LED is enough to easily destroy the LED itself unless it is conducted away from the LED so that the LED stays below the critical temperature of that particular model of LED. That critical temperature is typically above 200°. LED equipped light bulbs have dealt with the problem of dissipating in various ways. This can include making the output of the LEDs fairly low, having a large number of LEDs so that each one does not have to put out a lot of heat, and having various structures for dissipating heat. Improved ways of dissipating heat and making LEDs function to replace conventional incandescent light bulbs is therefore a desirable goal of a new product. The excellent ratio of light produced compared to energy spent making light make LEDs the lighting choice for the future, in all sorts of lighting situations, including room lighting.

SUMMARY OF THE DISCLOSURE

The invention is a light bulb which is based on LED technology, and which utilizes multiple LEDs mounted on heat radiating fins, and which has a base which is configured to fit in a standard socket for an incandescent bulb. The light bulb of the invention has a bulb base which is made up of a conductive socket with a first electrode at the apex of the socket and a second electrode around the sides of the socket. The second electrode is formed into the shape of a threaded cylinder, with the entire cylinder being conductive to the second electrode. The threaded cylinder circumvolves or surrounds the cylindrical bulb base. The upper edge of the second electrode forms the upper edge of the base. The shape of the lower part of the bulb base is the same shape as is found in a typical incandescent light bulb and fits into the socket of incandescent light bulbs.

Adjacent to the bulb base is a generally cylindrical radiator section. The radiator section has at least one generally circular radiator fin. The radiator fin extends from the cylindrical radiator section, and can be triangular, rectangular, or other shapes in cross section. The radiator fin or fins is/are configured to expel heat from the bulb. Preferably, the radiator section has more than one radiator fin, with an air space or groove between the radiator fins. The radiator section is also a heat sink, and may be machined, die cast, or stamped or made in any other conventional manner, with one or more radiating fins for providing additional surface area for dissipating heat to the atmosphere.

The bulb includes a base on which a globe fits. The globe may be secured by a twist lock, by threads, by a friction fit, or other conventional means of making a globe easily removable. The globe base can be flat or have some rise to it. The globe base on which the fin assembly and LED bulbs are placed can be made of a material such as epoxy, which is configured to be conductive of heat but non-conductive of electricity. Under the globe base of the bulb is a column that extends through the radiator section and into the bulb base. Electrical connections from the first and second electrode go through the column and the radiator section and connect to the LEDs.

The bulb also includes a globe of glass, plastic, or other material which covers the LED and which terminates at the upper edge of the radiator section. The globe serves to provide a grip for a user when screwing the bulb into an incandescent bulb socket. It also protects the LED bulb from contact with foreign objects. The interior of the globe does not need to be evacuated.

More than one LED is utilized by the bulb. One type of an LED is a square LED which is subdivided into four separate LED sections. Other multi-LED units can be utilized, including units with four, nine, or other combinations of LED units.

On top of the globe base is a fin assembly comprised of multiple fins 70 arranged in radial fashion around a central column 72. One side of the fins is an angled outer surface 74, and opposite the outer surface is an inner side 76 of each fin, which surround a core or central column 72. The core may be hollow, or may be filled with a heat transfer material. The exterior surface 74 of each fin 70 slopes outward from the central column area toward the bottom edge of the globe. The angle of each fin is important, because each fin has mounted on the exterior surface an LED. Since each LED has a predetermined cone of light that it emits, the angle at which the LED is mounted will determine the spread of light from the bulb. Thus if the exterior surface of the fins are sloped at 70 degrees, and the LED placed on the surface of the fin has a cone of light that puts out light at 125 to 140 degrees, the bulb can be built to have a chosen overlap or non-overlap of light from the top of the bulb. These angles can be adjusted for a particular bulb to provide light spread from the bulb as desired.

For example, if a fin is angled at 70 degrees, and the LED placed on it has a cone of emitted light of 125 degrees, a region of 27.5 degrees adjacent to the fin would not receive light from the LED.

Emergency lights are used in schools, office buildings, apartment buildings, churches and public buildings worldwide making their potential sales huge. Emergency stairway lighting can benefit from using LEDSs to more effectively project light downward onto stairs where it is needed in an emergency situation. Many current stairway emergency lights waste their light by directing at least half of it upward toward the ceiling. An LEDS would allow all the light emitted from emergency lights to go straight downward onto the stairs. An added benefit of using LEDSs with stairway emergency lights is that, since they use energy-efficient LEDs, the battery life would last 4 to 8 hours rather than the average 1.5 hours for incandescent bulbs.

The bulb also includes a printed electronic circuit, which is configured to control the functions of the LED light. This can include controlling the output, controlling the flow of electricity to the LED light, and functioning as an engine, a converter, a transformer, and/or a capacitor. The function of an engine in this context includes all of the elements necessary to provide an even and steady flow of electricity to the LED, including a transformer, capacitor, voltage regulator, and converter.

The light bulb of the invention also includes one or more openings for air movement, to facilitate cooling of the LED and its associated fins, heat sink and radiator. The air openings can include one or more in the globe base on which the cooling fins and LEDs are placed, and one or more near the top or sides of the globe. One version of the device has an air vent in the globe base between every other fin, and an air vent in the globe side at every other vent, so each fin has two cooling air sources, one on each side of the fin.

DETAILED DESCRIPTION OF THE EXEMPLARY EMBODIMENTS

Figure 1:
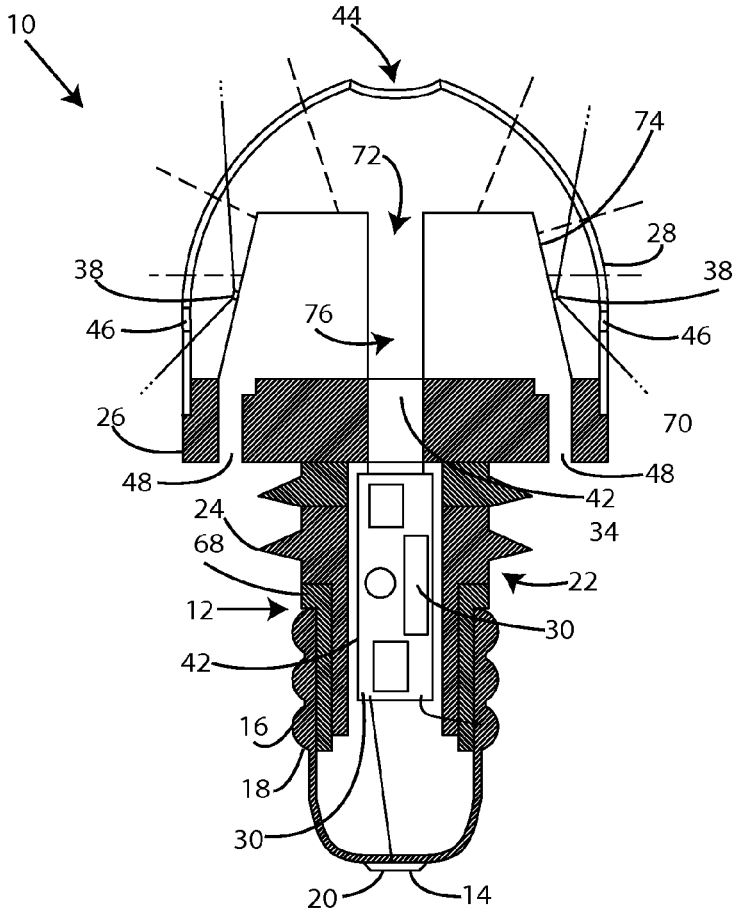
FIG. 1 is a side, cutaway view of the light bulb.
Figure 2:
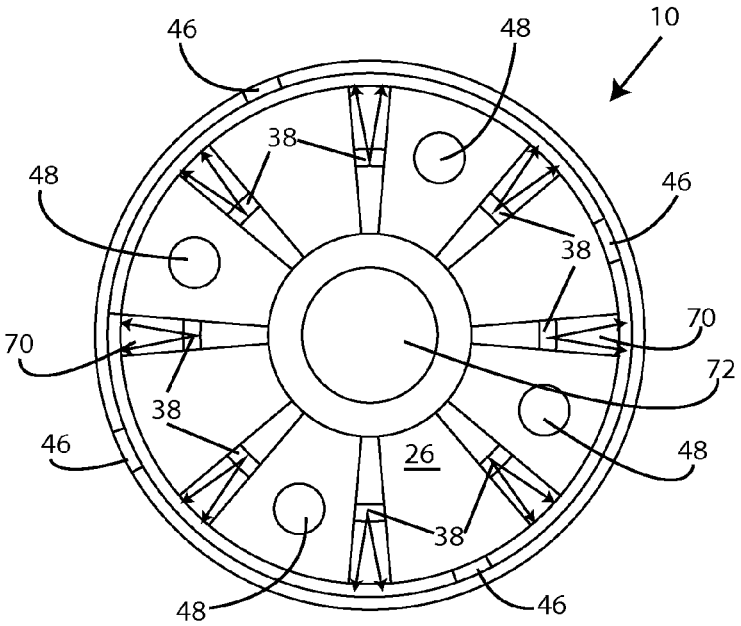
FIG. 2 is a top view of the light bulb depicting a possible location of the LED lights.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Several preferred embodiments of the LED light bulb of the invention are shown in the Figures.

FIG. 1 shows the LED light bulb 10 of the invention. It includes a bulb base 12 to which is attached a first electrode 14 and a second electrode 16. The second electrode 16 is electrically connected to the sidewall 18 of the bulb base. The bulb base 12 fits into a standard electrical socket for a light bulb. The bulb base 12 of the current invention thus connects the LED light bulb both physically and electrically to the electrical socket of a standard light bulb socket. Shown in FIG. 1 is the apex 20 of the light bulb.

Adjacent to the bulb base 12 is a radiator section 22 which includes at least one radiator ring 34 with a radiator fin 24. The radiator section 22 may include an additional radiator ring 34 which has an additional radiator fin 24. The radiator rings would preferably be made of aluminum, or another heat conducting material. Attached adjacent to the radiator section is a globe base 26. The globe base 26 would also be made of aluminum or another heat conducting material with similar properties to aluminum. The bulb base 12, the radiator rings 34, and the globe base 26, all define an interior column 42, in one preferred embodiment. As shown in FIG. 1, the column is a hollow portion that extends through all of these pieces. The column is capped by the globe base 26, on which is mounted fins 70 and LED light sources 38 on each fin. Inside the column 42 is positioned a control circuit board 30. The control circuit board 30 could also be positioned inside the globe base 26. Mounted on this control circuit board are the components that are typically required to power an LED light. These components can include a converter, a transformer, a capacitor, and a power selector. For instance, a selected LED light can be operated at different milliamps, and the power output in milliamps can be selected on the control board, or on a switch attached to the control board.

The column 42 shown in FIG. 1 is depicted as being hollow, but in the manufacturing process it would be filled with a liquid material which solidifies into a solid. Thus, the column 42 would be completely filled by solid material, preferably a type of epoxy or silicone which is nonconductive of electricity but which is conductive of heat.

Also shown in FIG. 1 is a globe 28 which is removably attached to the globe base 26. The attachment of the globe to the globe base can be by a friction mount, threaded, twist lock or other conventional attachment means. Shown in FIG. 1 is a first air hole 44 which is defined in the top of the globe 28, and also depicted is a second hole 46 in a lower portion of the globe 28, and a ventilation hole 48 in the globe base 26. The globe may be transparent to light, may be frosted, may be translucent, or colored or tinted, but the material of the globe allows light from the LEDs to pass through to light the surrounding area. Preferably the globe has four holes 46 spaced around the sidewalls, and 4 holes 48, so that no matter the orientation of the bulb, a convection path would be present for air to travel through the globe and directly over the LEDs and the fins 70. When the bulb is oriented upside down, hot air from the fins and LED enter the apex of the globe at 44, and exits through the side holes 46 and base holes 48. If the bulb is on its side, air can enter the lower of the side holes 46 or base holes 48, and exit out any of the holes above the entry holes, including out the vent hole 44 in the globe top. If the globe is oriented with the globe up, air could enter at 48 and 46 holes, pass over the hot fins and LEDs, and exit by the globe top hole 44. Each of these orientations creates a natural convection pathway through the globe, and directly over the LED and the heat radiating fins.

One version of the bulb has holes in the globe base and holes in the side of the globe which are positioned in relation to the fins on which the LEDs are placed. This version might have 8 fins with LEDs on them. It would also have 4 holes in the globe base, and they would be positioned between the fins. It would also have 4 holes in the side of the globe, so that ever space between the fins had either a hole in the base or a hole in the globe side. In this way every fin would have an air source on either side of the fin.

Shown is an insulator 68 which insulates the radiating section 22 from electricity from the bulb base.

A suitable type of material to form the column 42 of the invention is a product called TCR, made by Electrolube. It is a thermal transfer material and provides excellent thermal conductivity and cures at room temperature without an oil residue. RTV stands for Room Temperature Vulcanizing, and these materials are typically silicone based and contain a proprietary mix of mineral fillers which aid in heat conduction.

A type of LED which has proven successful is an LED that operates between 300 milliamps and 750 milliamps. A switch on the device can be used to adjust the intensity of light output for this reason. It is to be understood that this is merely one example of a suitable LED, and the invention is made to be useful with any number of LEDs, depending on the particular application that a particular bulb is designed for. More light can be produced by increasing the wattage, or by increasing the number of fins with LEDs.

What is claimed is:

1. An LED light bulb for use with a socket for incandescent bulbs, comprising:

a bulb base, comprising a conductive socket with a first electrode at an apex of said socket, and a second electrode formed of a conductive threaded cylinder which circumvolves said bulb base, with said second electrode comprising a base edge, with said electrodes configured to physically and electrically to engage a standard light bulb socket configured for incandescent bulbs;

a generally cylindrical radiator section attached adjacent to said bulb base, said radiator section with at least one generally circular radiator fin, which is configured to expel heat from said bulb, with said bulb base and said radiator section forming an internal column;

a generally cylindrical globe base attached to said radiator section, said globe base having a generally planar top surface and a globe attachment surface on a periphery of said globe base;

a fin array attached to said top surface of said globe base, said fin array comprised of a plurality of fins arranged in a radial fashion radiating from a center of said globe base, with each fin having an angled outer surface directed outward from said globe base, and inner surfaces defining a central core;

a plurality of LED lights with each LED light positioned on said angled outer surface of said fins, and electrically connected to said first and second electrode by electrical connections, and configured to emit light when energized;

with said column filled with a heat conductive and electricity non-conductive material, said material in thermal contact with said LED and said radiator section, for insulating said electrical connections from electricity, and for conducting heat from said LED to said radiator section; and a light passing globe covering said fin array and said LEDs, and covering said top surface of said globe base, with said LEDs configured to emit light when energized, and said globe providing a handling surface for a user to grip the light bulb during insertion into a socket, and to protect said LED from contact with foreign objects, with said LED light bulb configured to interfit with standard incandescent bulb sockets.

2. The LED based light bulb of claim 1 in which said radiator section further comprises a plurality of radiator fins for expelling heat produced by said at least one LED.

3. The LED based light bulb of claim 1 in which said angled outer surface of each fin is at an angle to the surface of the globe base of about 70 degrees or less.

4. The LED based light bulb of claim 1 in which said epoxy fills said bulb base to provide added structural strength to said base.

5. The LED based light bulb of claim 1 which further comprises an electronic circuitry to control the output of the LED lights.

6. The LED based light bulb of claim 5, in which said electronic circuitry is configured to function as one or more devices selected from the list comprising an engine, a converter, a transformer, and a capacitor.

7. The LED based light bulb of claim 1 in which said globe further comprises one or more openings for air circulation.

8. The LED based light bulb of claim 7 in which said openings for air circulation include an opening adjacent said bulb top edge, and an opening near said globe top.

9. The LED based light bulb of claim 1 in which said globe has a light diffusing coating.

10. The LED based light bulb of claim 1 which further comprises alternating air vent holes in the globe base and the globe side, so that every fin has an air vent hole on either side of each fin.

* * * * *